US011814981B2

(12) United States Patent
Koda

(10) Patent No.: US 11,814,981 B2
(45) Date of Patent: Nov. 14, 2023

(54) TURBINE BLADE AND STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 58 days.

(21) Appl. No.: 16/746,022

(22) Filed: Jan. 17, 2020

(65) Prior Publication Data

US 2020/0263551 A1 Aug. 20, 2020

(30) Foreign Application Priority Data

Feb. 14, 2019 (JP) ..... 2019-024406

(51) Int. Cl.
*F01D 5/14* (2006.01)
*F01D 17/16* (2006.01)

(52) U.S. Cl.
CPC ..... *F01D 5/142* (2013.01); *F01D 17/162* (2013.01); *F05B 2240/12* (2013.01); *F05B 2240/30* (2013.01); *F05D 2220/31* (2013.01)

(58) Field of Classification Search
CPC ..... F01D 5/142; F01D 17/162; F01D 5/143; F01D 5/145; F05B 2240/30; F05B 2240/12; F05D 2220/31; F05D 2250/184; F05D 2240/80
See application file for complete search history.

(56) References Cited

U.S. PATENT DOCUMENTS 7,500,824 B2 * 3/2009 Cheng ..... F01D 11/001 415/173.4
9,309,783 B2 * 4/2016 Nallam ..... F01D 11/02
2009/0053066 A1 2/2009 Iida
2011/0243749 A1 * 10/2011 Praisner ..... F01D 5/225 416/223 A
2013/0108448 A1 * 5/2013 Ingram ..... F01D 5/143 416/193 R (Continued)

FOREIGN PATENT DOCUMENTS

JP S56-069402 A 6/1981
JP S5669402 A * 6/1981 ..... F01D 11/08

(Continued)

*Primary Examiner* — Woody A Lee, Jr.
*Assistant Examiner* — Eric A Lange
(74) *Attorney, Agent, or Firm* — Osha Bergman Watanabe & Burton LLP

(57) ABSTRACT

A rotor blade 32 includes a blade body 33 which has a negative-pressure surface 33*a* and a positive-pressure surface 33*b* extending in a blade height direction Z, and a platform 35 which is connected to an end portion of the blade body 33 in the blade height direction Z and extends in a circumferential direction Dc. In an end surface 35*a* of the platform 35 facing an axial direction Da, a convex portion 51 protruding in the axial direction Da and a concave portion 52 recessed in the axial direction Da are formed on an end surface 35*a* of the platform 35 facing the upstream side Dau. When viewed in the blade height direction Z, the convex portion 51 and the concave portion 52 are alternately formed in the circumferential direction Dc.

8 Claims, 4 Drawing Sheets

(56) References Cited

U.S. PATENT DOCUMENTS

| | | | | |
|---|---|---|---|---|
| 2013/0108450 | A1* | 5/2013 | Ingram | F01D 5/145<br>416/223 A |
| 2015/0107265 | A1* | 4/2015 | Smith | F01D 5/143<br>60/805 |
| 2016/0215626 | A1 | 7/2016 | Chouhan et al. | |
| 2016/0258302 | A1* | 9/2016 | Benson | F01D 5/02 |
| 2019/0003323 | A1* | 1/2019 | Shirley | F01D 5/143 |

FOREIGN PATENT DOCUMENTS

| | | | |
|---|---|---|---|
| JP | 2000-073702 | A | 3/2000 |
| JP | 4616781 | B2 | 1/2011 |
| JP | 5010507 | B2 | 8/2012 |
| JP | 2016-138551 | A | 8/2016 |

* cited by examiner

TURBINE BLADE AND STEAM TURBINE

BACKGROUND OF THE INVENTION

Field of the Invention

The present disclosure relates to a turbine blade and a steam turbine.

Priority is claimed on Japanese Patent Application No. 2019-024406, filed on Feb. 14, 2019, the content of which is incorporated herein by reference.

Description of Related Art

A steam turbine includes a rotor which is configured to rotate about an axis and a casing which covers the rotor. The rotor has a rotor shaft which extends in an axial direction about an axis and a plurality of rotor blade rows which are fixed to an outer periphery of the rotor shaft and are arranged in the axial direction. Each rotor blade row includes a plurality of rotor blades which are disposed in a circumferential direction. Moreover, the steam turbine has a stator vane row which is fixed to an inner peripheral surface of the casing and is disposed on an upstream side of each of the plurality of rotor blade rows. Each stator vane row includes a plurality of stator vanes which are disposed in the circumferential direction.

In the steam turbine, a secondary flow is generated in an inter-blade channel between the rotor blades and between the stator vanes adjacent to each other in the circumferential direction. As a result, a loss may occur in the fluid flow in the inter-blade channel. As a factor which causes the secondary flow, for example, there is separation of a boundary layer formed in the vicinity of a platform of the rotor blade. In order to increase turbine efficiency, it is necessary to limit the loss caused by the secondary flow in the inter-blade channel.

For example, Japanese Patent No. 4616781 discloses a structure which includes a concave portion which is recessed in a radial direction of a rotation axis and a convex portion which protrudes in the radial direction of the rotation axis from an end wall (platform) between adjacent turbine blades. In addition, Japanese Patent No. 5010507 discloses a configuration which includes a concave portion, which is recessed in a radial direction of a rotation axis, on an end wall.

SUMMARY OF THE INVENTION

As disclosed in Japanese Patent No. 4616781 and Japanese Patent No. 5010507, when the convex portion protruding in the radial direction or the concave portion recessed in the radial direction is provided with respect to the end wall, in an inter-blade channel, a channel size of a fluid flowing from an upstream side to a downstream side in the axial direction increases or decreases in the radial direction. As a result, a loss occurs in a portion where the channel cross-sectional area increases or decreases and is changed. Accordingly, there is room for further limiting this loss and improving the turbine efficiency.

The present disclosure provides a turbine blade and a steam turbine capable of further limiting the loss caused by the secondary flow and further increasing the turbine efficiency.

According to a first aspect of the present disclosure, there is provided a turbine blade which is provided in a steam turbine having a steam main channel which is formed around a rotor shaft which is configured to rotate about an axis and through which steam flows, the turbine blade including: a blade body of which a leading edge is disposed to face an upstream side in a flow direction of the steam in the steam main channel and which has a blade surface extending in a blade height direction; and an end plate which is connected to an end portion of the blade body in the blade height direction and extends in a first direction intersecting the blade height direction, in which a convex portion protruding in a second direction intersecting the blade height direction and the first direction and a concave portion recessed in the second direction are formed on an end surface of the end plate facing the second direction and facing the upstream side, and when viewed in the blade height direction, the convex portion and the concave portion are alternately formed in the first direction.

According to this configuration, the steam flowing from the upstream side collides with the convex portion and the concave portion formed on the upstream side end surface of the end plate and a vertical vortex which rises radially from the end surface is generated. Due to the vertical vortex, a turbulence can be generated in a flow at a position close to the end plate in flows along the blade surface. Thereby, it is possible to limit growth and separation of a boundary layer, which is a flow along the blade surface, in the vicinity of the end plate. Accordingly, it is possible to limit a loss caused by a secondary flow between the blade bodies adjacent to each other in a circumferential direction. As a result, it is possible to further increase turbine efficiency.

Moreover, in the turbine blade according to a second aspect of the present disclosure, in the first aspect, when viewed in the blade height direction, the convex portion and the concave portion may be disposed on an upstream side with respect to the leading edge of the blade body.

According to this configuration, in the downstream side from the leading edge of the blade body, a dimension in the blade height direction in a channel between the blade bodies adjacent to each other in the circumferential direction is not changed. Accordingly, the convex portion and the concave portion are formed, and thus, it is possible to prevent a cross-sectional area of the channel between the blade bodies from being changed. Therefore, a loss caused by the secondary flow can be limited while limiting an influence on the steam flowing through a portion between the blade bodies.

In addition, in the turbine blade according to a third aspect of the present disclosure, in the first aspect or the second aspect, when viewed in the blade height direction, surfaces of the convex portion and the concave portion facing the upstream side may form a curved line which is continuous in the first direction.

According to this configuration, a position at which the vertical vortex is generated in the axial direction is continuously changed in the circumferential direction. Thereby, an effect for limiting the loss caused by the secondary flow is favorably acquired by the vertical vortex.

Moreover, in the turbine blade according to a fourth aspect of the present disclosure, in any one of the first to third aspects, when viewed in the blade height direction, at least one of the concave portion and the convex portion may be formed in plurality.

According to this configuration, it is possible to increase the number of occurrences of the vertical vortex. As a result, the effect for limiting the loss caused by the secondary flow is favorably acquired by the vertical vortex.

Moreover, according to a fifth aspect of the present disclosure, there is provided a turbine including: a rotor shaft which is configured to rotate about an axis; and the turbine blade according to any one of the first to fourth aspects which is disposed such that the second direction coincides with an axial direction of the rotor shaft.

According to the present disclosure, it is possible to further increase the turbine efficiency while limiting the loss caused by the secondary flow.

DETAILED DESCRIPTION OF THE DISCLOSURE

Hereinafter, an embodiment of a turbine of the present disclosure will be described with reference to the drawings. However, the present disclosure is not limited only to the embodiment.

Figure 1:
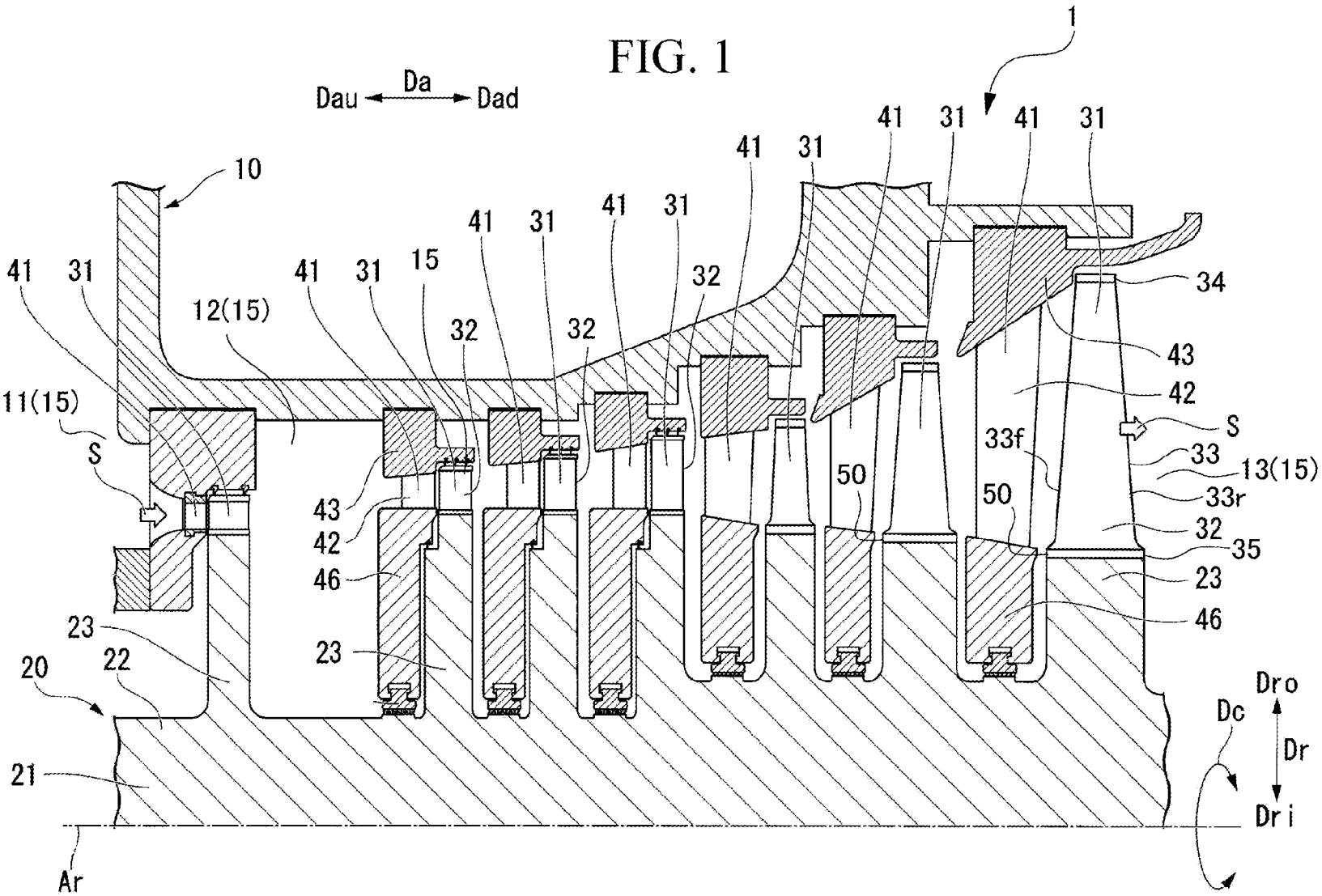
FIG. 1 is a cross-sectional view of a steam turbine in an embodiment of the present disclosure.

FIG. 1 is a cross-sectional view of a steam turbine in an embodiment of the present disclosure. As shown in FIG. 1, a steam turbine 1 of the present embodiment includes a rotor 20 which rotates about an axis Ar and a casing 10 which covers the rotor 20 so that the rotor 20 is rotatable.

In addition, for convenience of the following descriptions, a direction in which the axis Ar extends is referred to as an axial direction Da. Moreover, a first side in the axial direction Da is referred to as an upstream side (one side) Dau, and a second side in the axial direction Da is referred to as a downstream side (the other side) Dad. In addition, a radial direction in a shaft core portion 22 described later with reference to the axis Ar is simply referred to as a radial direction Dr. Moreover, a side closer to the axis Ar in the radial direction Dr is referred to as a radially inner side Dri, and a side opposite to the radially inner side Dri in the radial direction Dr is referred to as a radially outer side Dro. In addition, a circumferential direction of the shaft core portion 22 about the axis Ar is simply referred to as a circumferential direction Dc.

The rotor 20 has a rotor shaft 21 and rotor blade rows 31. The rotor shaft 21 extends in the axial direction Da about the axis Ar. The rotor shaft 21 has a shaft core portion 22 and a plurality of disk portions 23. The shaft core portion 22 is formed in a columnar shape extending in the axial direction Da. The plurality of disk portions 23 extend from the shaft core portion 22 to the radially outer side Dro and are arranged with gaps therebetween in the axial direction Da. The disk portion 23 is provided for each of the plurality of rotor blade rows 31.

The casing 10 includes a nozzle chamber 11 into which steam S flows from an outside, a steam main channel chamber 12 through which the steam S from the nozzle chamber 11 flows, and an exhaust chamber 13 through which the steam S which has flowed from the steam main channel chamber 12 is discharged. The nozzle chamber 11, the steam main channel chamber 12, and the exhaust chamber 13 constitute a steam main channel 15 in the casing 10, and the high-pressure steam S flows through the steam main channel 15.

The high-pressure steam S flows through the steam main channel 15 while the pressure of the steam S gradually decreases from the upstream side Dau toward the downstream side Dad. That is, in the present embodiment, the flow direction of the steam S is a direction from the upstream side Dau to the downstream side Dad in the axial direction Da. The steam main channel 15 is formed in an annular shape around the rotor shaft 21. The steam main channel 15 extends in the axial direction Da across the plurality of rotor blade rows 31 and a plurality of the stator vane rows 41.

Figure 2:
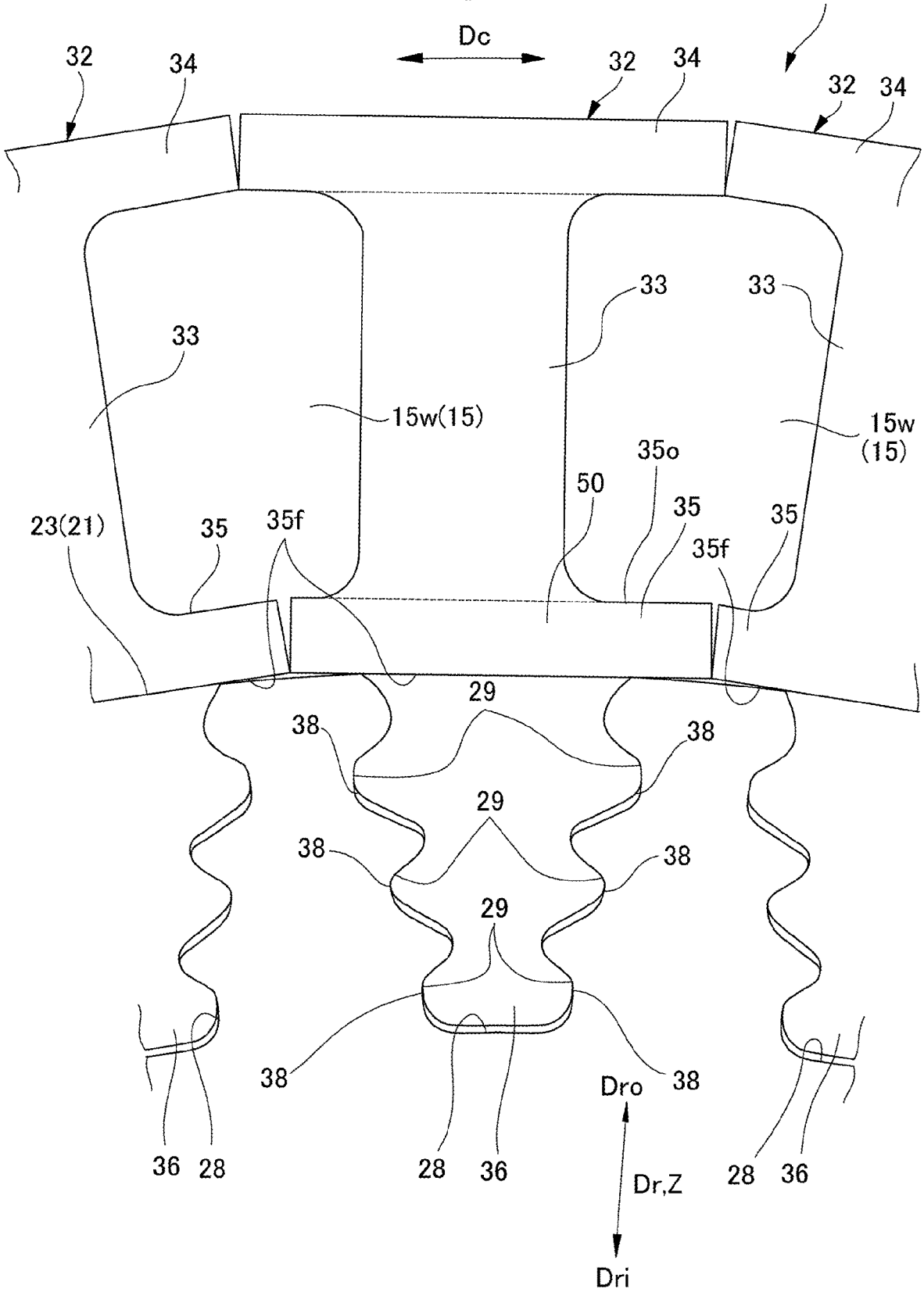
FIG. 2 is a view when a portion of a rotor blade row of the steam turbine in the present embodiment is viewed in an axial direction.

FIG. 2 is a view when a portion of the rotor blade row of the steam turbine in the present embodiment is viewed in the axial direction. As shown in FIGS. 1 and 2, the rotor blade row 31 is attached to an outer periphery of the disk portion 23 which is an outer peripheral portion of the rotor shaft 21. A plurality of rows of the rotor blade rows 31 are provided at intervals along the axial direction Da of the rotor shaft 21. In the case of the present embodiment, the number of the rotor blade rows 31 is seven. Accordingly, in the case of the present embodiment, a first stage rotor blade row 31 to a seventh stage rotor blade row 31 are provided.

Each rotor blade row 31 has a plurality of rotor blades (turbine blades) 32 arranged in the circumferential direction Dc. Each rotor blade 32 includes a blade body 33, a shroud 34, a platform (end plate) 35, and a blade root 36.

Figure 3:
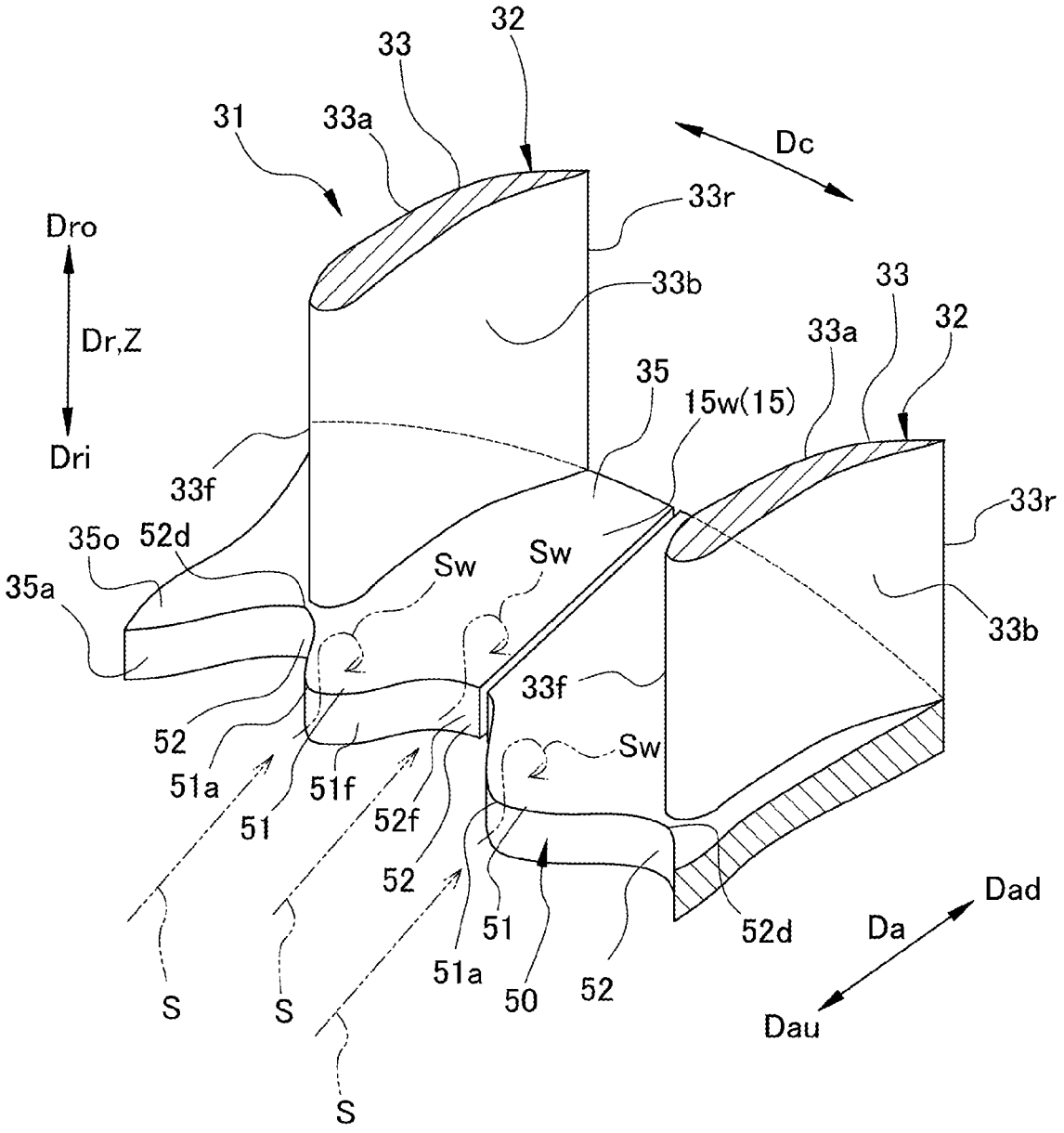
FIG. 3 is a perspective view showing a portion of a blade body and a platform constituting the rotor blade row in the present embodiment.
Figure 4:
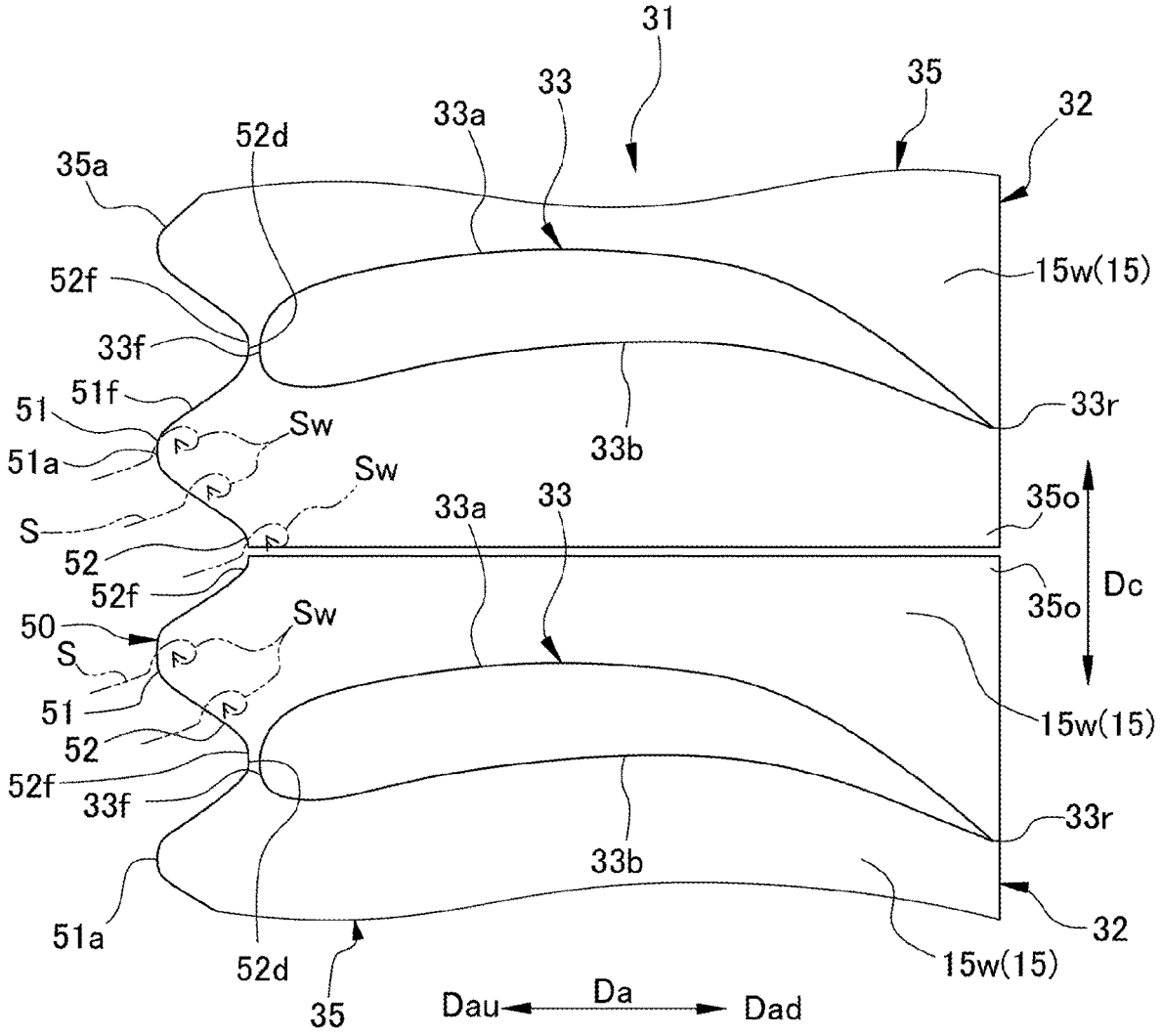
FIG. 4 is a view when the blade body and the platform in the present embodiment are viewed from an outside in a radial direction.

FIG. 3 is a perspective view showing a portion of the blade body and the platform constituting the rotor blade row in the present embodiment. FIG. 4 is a view when the blade body and the platform in the present embodiment are viewed from the radially outer side.

As shown in FIGS. 1 to 4, the blade body 33 is disposed in the steam main channel 15. The blade body 33 extends in a blade height direction Z. The blade body 33 has an airfoil cross section in which a convex negative-pressure surface (blade surface) 33*a* extending in the blade height direction Z and a concave positive-pressure surface (blade surface) 33*b* extending in the blade height direction Z are continuously connected to each other via a leading edge 33*f* and a trailing edge 33*r*.

As shown in FIGS. 3 and 4, in the blade body 33, the negative-pressure surface 33*a* is formed so as to protrude toward the first side of the circumferential direction Dc. In the blade body 33, the positive-pressure surface 33*b* is formed so as to be recessed from the second side in the circumferential direction Dc opposite to the first side in the circumferential direction Dc toward the first side in the circumferential direction Dc.

The leading edge 33*f* is an end portion on the upstream side Dau of the blade body 33. The leading edge 33*f* is a portion where the negative-pressure surface 33*a* and the positive-pressure surface 33*b* are connected to each other in a cross section orthogonal to the blade height direction Dh. The trailing edge 33*r* is an end portion on the downstream side Dad of the blade body 33. The trailing edge 33*r* is a portion where the negative-pressure surface 33*a* and the positive-pressure surface 33*b* are connected to each other on a side opposite to the leading edge 33*f* in the axial direction Da in the cross section orthogonal to the blade height direction Dh.

Moreover, in the present embodiment, the blade height direction Z is the radial direction Dr. Therefore, a first direction orthogonal to (intersecting) the blade height direction Z is the circumferential direction Dc, and a second direction orthogonal to (intersecting) the blade height direction Z and the first direction is the axial direction Da.

The shroud 34 is connected to an end portion of the radially outer side Dro with respect to the blade body 33. The shroud 34 is formed integrally with the blade body 33. The shroud 34 extends in the circumferential direction Dc. The shrouds 34 of the plurality of rotor blades 32 are arranged in a circumferential direction Dc to form a cylindrical shape as a whole.

As shown in FIGS. 1 and 2, the platform 35 is connected to an end portion of the radially inner side Dri with respect to the blade body 33. The platform 35 is formed integrally with the blade body 33. The platform 35 extends in the circumferential direction Dc. The platforms 35 of the plurality of rotor blades 32 are arranged in a circumferential direction Dc to form a cylindrical shape as a whole. The blade body 33 extends from a platform outer peripheral surface 35*o* of the platform 35 facing the radially outer side Dro. The platform outer peripheral surface 35*o* is a smooth surface on which irregularities preventing the flow of steam S in the axial direction Da are not formed.

As shown in FIGS. 2 to 4, a space surrounded by the blade bodies 33 adjacent to each other in the circumferential direction Dc and the shroud 34 and the platform 35 facing each other in the radial direction Dr is an inter-blade channel 15*w* through which steam S flows. The plurality of rotor blades 32 are provided in the circumferential direction Dc. Accordingly, a plurality of the inter-blade channels 15*w* are formed in the circumferential direction Dc. The plurality of inter-blade channels 15*w* arranged in the circumferential direction Dc form a portion of the steam main channel 15 through which steam S flows.

As shown in FIG. 2, a blade root 36 is connected to the radially inner side Dri of the platform 35. The blade root 36 is formed so as to extend from a platform inner peripheral surface 35*f* facing the radially inner side Dri of the platform 35 to the radially inner side Dri. The blade root 36 has an engagement convex portion 38 which protrudes toward both sides in the circumferential direction Dc. The engagement convex portion 38 is provided at a plurality of positions at intervals along the radial direction Dr. The plurality of engagement convex portions 38 are formed such that the protruding dimension in the circumferential direction Dc gradually decreases toward the radially inner side Dri. Accordingly, the blade root 36 is formed in a so-called Christmas tree shape.

In the disk portion 23 of the rotor 20, a blade groove 28 into which the engagement convex portion 38 engages is formed. The blade groove 28 is recessed from an outer peripheral surface of the disk portion 23 to the radially inner side Dri. The blade groove 28 is formed to correspond to an outer peripheral shape of the blade root 36. The blade groove 28 has engagement concave portions 29 which are recessed toward both sides of the circumferential direction Dc at a plurality of locations at intervals along the radial direction Dr.

As shown in FIG. 1, the steam turbine 1 includes the plurality of stator vane rows 41 which are fixed to an inner peripheral surface of the casing 10 and are provided at intervals along the axial direction Da. In the case of the present embodiment, the number of stator vane rows 41 is seven which is the same as the number of rotor blade rows 31. Accordingly, in the case of the present embodiment, a first stage stator vane row 41 to a seventh stage stator vane row 41 are provided. The plurality of stator vane rows 41 are disposed adjacent to the upstream side Dau with respect to the respective rotor blade rows 31.

Each of the stator vane row 41 includes a plurality of stator vanes 42, an outer ring 43, and an inner ring 46. The plurality of stator vanes 42 are provided an interval in the circumferential direction Dc. The outer ring 43 is formed in an annular shape and is provided on the radially outer side Dro of the plurality of stator vanes 42. The inner ring 46 is formed in an annular shape and is provided on the radially inner side Dri of the plurality of stator vanes 42. That is, the plurality of stator vanes 42 are disposed between the outer ring 43 and the inner ring 46. The stator vane 42 is fixed to the outer ring 43 and the inner ring 46. An annular space between the outer ring 43 and the inner ring 46 forms a portion of the steam main channel 15 through which steam S flows.

As shown in FIGS. 3 and 4, a convex portion 51 and a concave portion 52 are formed in the platform 35. The convex portion 51 and the concave portion 52 are provided on an end surface 35*a* of the platform 35 facing the upstream side Dau. Due to the convex portion 51 and the concave portion 52 of the present embodiment, the end surface 35*a* is formed as an uneven surface 50. That is, the convex portion 51 and the concave portion 52 are formed over the entire region of the end surface 35*a* of the present embodiment.

The convex portion 51 and the concave portion 52 are alternately formed in the circumferential direction Dc. The convex portion 51 protrudes toward the upstream side Dau when viewed in the radial direction Dr. The concave portion 52 is recessed toward the downstream side Dad when viewed in the radial direction Dr. A surface 51*f* of the convex portion 51 facing the upstream side Dau and a surface 52*f* of the concave portion 52 facing the upstream side Dau are surfaces orthogonal to the axial direction Da.

The surface 51*f* of the convex portion 51 and the surface 52*f* of the concave portion 52 are continuous in the circumferential direction Dc. Accordingly, the uneven surface 50 forms a curved line which is continuous in the circumferential direction Dc when viewed in the radial direction Dr. That is, the uneven surface 50 has a wave shape when viewed from the outside in the radial direction Dr.

The convex portion 51 and the concave portion 52 are formed on the upstream side Dau from the leading edge 33*f* of the blade body 33 when viewed from the outside in the radial direction Dr. That is, a bottom portion 52*d* of the concave portion 52 located at the most downstream side Dad on the uneven surface 50 is disposed on the upstream side Dau from the leading edge 33*f* of the blade body 33.

In addition, the present disclosure is not limited to the case where one convex portion 51 and one concave portion 52 is disposed for one platform 35. For example, at least one of the convex portion 51 and the concave portion 52 may be formed in plurality in one platform 35. In the present embodiment, the position of the circumferential direction Dc at the bottom portion 52*d* of the concave portion 52 is arranged to coincide with the position of the circumferential direction Dc at the leading edge 33*f* of the blade body 33. Moreover, two convex portions 51 and one concave portion 52 are disposed between the blade bodies 33 adjacent to each other in the circumferential direction Dc. Specifically, a plurality of convex portions 51 are formed for one platform 35.

In addition, for example, a portion of the convex portion 51 or the concave portion 52 may be formed on one platform 35 and the remaining portion may be formed on another (other) platform 35 disposed next to the platform 35.

In this steam turbine 1, the steam S is fed from the upstream side Dau of the casing 10 via the nozzle chamber 11. The steam S flows through the steam main channel 15 to the exhaust chamber 13 on the downstream side Dad. Accordingly, the rotor shaft 21 rotates around the axis Ar, and each rotor blade 32 rotates about the axis Ar together with the disk portion 23. At this time, in each rotor blade 32, the steam S flows through the inter-blade channel 15*w* between the blade bodies 33 adjacent to each other in the circumferential direction.

According to the above-described rotor blade 32, when the flow of the steam S collides with the uneven surface 50, a vertical vortex Sw which rises to the radially outer side Dro is generated. The vertical vortex Sw turns on the platform outer peripheral surface 35*o* along a virtual plane including the radial direction Dr and the axial direction Da. The convex portions 51 and the concave portions 52 are alternately formed on the uneven surface 50 in the circumferential direction Dc. Therefore, the position of the circumferential direction Dc is changed, and thus, the position in the axial direction Da at which the vertical vortex Sw is generated is shifted in the axial direction Da. Specifically, in a distal end portion 51*a* of the convex portion 51, the position in the axial direction Da at which the vertical vortex Sw is generated is the most upstream side Dau. In the bottom portion 52*d* of the concave portion 52, the position in the axial direction Da at which the vertical vortex Sw occurs is the most downstream side Dad. Between the distal end portion 51*a* of the convex portion 51 and the bottom portion 52*d* of the concave portion 52, the position in the axial direction Da at which the vertical vortex Sw is generated is between the position at which the vertical vortex Sw is generated in the distal end portion 51*a* of the convex portion 51 and the position at which the vertical vortex Sw is generated in the bottom portion 52*d* of the concave portion 52. Due to the vertical vortex Sw, a turbulence can be generated in a flow at a position close to the platform outer peripheral surface 35*o* in flows along the negative-pressure surface 33*a* and the positive-pressure surface 33*b*. Thereby, it is possible to limit growth and separation of a boundary layer, which is a flow of the steam S along the negative-pressure surface 33*a* and the positive-pressure surface 33*b*, in the vicinity of the platform outer peripheral surface 35*o*. Accordingly, it is possible to limit a loss caused by a secondary flow in the inter-blade channel 15*w* between the blade bodies 33 adjacent to each other in the circumferential direction Dc. As a result, it is possible to further increase the turbine efficiency of the steam turbine 1.

In addition, the convex portion 51 and the concave portion 52 are formed on the upstream side Dau from the leading edge 33*f* on the most upstream side Dau in the blade body 33. Thereby, a shape of the platform 35 is not changed in a region of the downstream side Dad from the leading edge 33*f* of the blade body 33. Therefore, in the inter-blade channel 15*w* between the blade bodies 33 adjacent to each other in the circumferential direction Dc, a dimension in the radial direction Dr is not changed. Thereby, by forming the convex portion 51 and the concave portion 52 that disturb the flow of the steam S, it is possible to prevent a cross-sectional area of the inter-blade channel 15*w* from being changed according to the position of the axial direction Da. Therefore, a loss caused by the secondary flow can be limited while limiting an influence on the steam S flowing through the inter-blade channel 15*w*.

In addition, the uneven surface 50 forms a curved line which is smoothly continuous in the circumferential direction Dc when viewed in the radial direction Dr. That is, a convex portion protruding at an acute angle or a concave portion recessed at an acute angle is not formed. Therefore, the position at which the vertical vortex Sw is generated in the axial direction Da is continuously changed in the circumferential direction Dc. Thereby, an effect for limiting the loss caused by the secondary flow is favorably acquired by the vertical vortex Sw.

Moreover, the plurality of convex portions 51 are formed between the blade bodies 33 adjacent to each other in the circumferential direction Dc. Accordingly, compared to a case where only one convex portion 51 and one concave portion 52 are formed, it is possible to increase the number of occurrences of the vertical vortex Sw in the inter-blade channel 15*w*. As a result, the effect for limiting the loss caused by the secondary flow is favorably acquired by the vertical vortex Sw.

While preferred embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

Moreover, in the embodiment, the convex portion 51 and the concave portion 52 are formed only in the platform 35. However, the convex portion 51 and the concave portion 52 are not limited to being formed on the rotor blade 32. For example, the convex portion 51 and the concave portion 52 may be formed in the stator vane 42. Therefore, the convex portion 51 and the concave portion 52 may be formed on a surface of the outer ring 43 or the inner ring 46 facing the upstream side Dau with the outer ring 43 or the inner ring 46 as an end plate thereof.

Further, even in the case where the convex portion 51 and the concave portion 52 are formed on the rotor blade 32, the convex portion 51 and the concave portion 52 are not limited to being formed only in the platform 35. For example, in the case where the convex portion 51 and the concave portion 52 are formed in the rotor blade 32, the convex portion 51 and the concave portion 52 may be formed on a surface of the shroud 34 facing the upstream side Dau with the shroud 34 as an end plate thereof.

Moreover, in the embodiment, the convex portion 51 and the concave portion 52 are formed so that the uneven surface 50 has a wave shape when viewed in the circumferential direction Dc. However, the convex portion 51 and the concave portion 52 are not limited to have the above-described shape. For example, the convex portion 51 and the concave portion 52 may have a rectangular shape or a triangular shape when viewed in the circumferential direction Dc.

Moreover, if a seal fin or the like is provided on the end surface 35*a*, the convex portion 51 and the concave portion 52 may be formed at least in a region connected to the platform outer peripheral surface 35*o* in the region of the end surface 35*a* in the radial direction Dr.

EXPLANATION OF REFERENCES

1: steam turbine
10: casing
15: steam main channel
15*w*: inter-blade channel
20: rotor
21: rotor shaft
22: shaft core portion
23: disk portion

28: blade groove
29: engagement concave portion
31: rotor blade row
32: rotor blade (turbine blade)
33: blade body
33*a*: negative-pressure surface
33*b*: positive-pressure surface
33*f*: leading edge
33*r*: trailing edge
34: shroud
35: platform (end plate)
35*a*: end surface
35*f*: platform inner peripheral surface
35*o*: platform outer peripheral surface
36: blade root
38: engagement convex portion
41: stator vane row
42: stator vane
43: outer ring
46: inner ring
50: uneven surface
51: convex portion
51*a*: distal end portion
51*f*: surface facing upstream side
52: concave portion
52*d*: bottom portion
52*f*: surface facing upstream side
Ar: axis
Da: axial direction
Dad: downstream side
Dau: upstream side
Dc: circumferential direction
Dr: radial direction
Dri: radially inner side
Dro: radially outer side
S: steam
Sw: vertical vortex

What is claimed is:

1. A turbine blade for a steam turbine having a rotor shaft that rotates about a rotation axis and a steam main channel formed around the rotor shaft, the turbine blade comprising:

a blade body comprising:

a blade surface extending in a blade height direction; and a leading edge that faces an upstream side in a flow direction of steam in the steam main channel; and an end plate connected to an end of the blade body in the blade height direction and that extends in a first direction intersecting the blade height direction, wherein the end plate comprises an end surface facing a second direction intersecting the blade height direction and the first direction and facing the upstream side, the end surface of the end plate comprises:

a convex portion protruding in the second direction and comprising a surface with which the steam collides, the surface being orthogonal to the rotation axis; and a concave portion recessed in the second direction and comprising a surface with which the steam collides, the surface being orthogonal to the rotation axis, when viewed from above/below the convex portion and the concave portion in reference to an axis parallel to a height dimension of the turbine blade, the convex portion and the concave portion are alternately formed in the first direction, the convex portion and the concave portion are formed over an entire height of the end plate in a thickness direction of the end plate, an entirety of the concave portion is disposed upstream of the leading edge of the blade body in the second direction, a position of a bottom of the concave portion in the first direction coincides with a position of the leading edge in the first direction, and the convex portion and the concave portion are disposed on the upstream side with respect to the leading edge.

2. The turbine blade according to claim 1, wherein when viewed from above/below the convex portion and the concave portion in reference to the axis, surfaces of the convex portion and the concave portion facing the upstream side form a curved line that is continuous in the first direction.

3. The turbine blade according to claim 2, wherein when viewed from above/below the convex portion and the concave portion in reference to the axis, at least one of the concave portion and the convex portion is formed in plurality.

4. The steam turbine comprising the turbine blade according to claim 3, wherein the turbine blade is disposed such that the second direction coincides with an axial direction of the rotor shaft.

5. The steam turbine comprising the turbine blade according to claim 2, wherein the turbine blade is disposed such that the second direction coincides with an axial direction of the rotor shaft.

6. The turbine blade according to claim 1, wherein when viewed from above/below the convex portion and the concave portion in reference to the axis, at least one of the concave portion and the convex portion is formed in plurality.

7. The steam turbine comprising the turbine blade according to claim 6, wherein the turbine blade is disposed such that the second direction coincides with an axial direction of the rotor shaft.

8. The steam turbine comprising the turbine blade according to claim 1, wherein the turbine blade is disposed such that the second direction coincides with an axial direction of the rotor shaft.

* * * * *